United States Patent [19]

Merker et al.

[11] 4,046,367

[45] Sept. 6, 1977

[54] MODIFIED HIGH SPEED PAPER INSERTING APPARATUS AND METHOD

[75] Inventors: George Merker, Fair Lawn; Menashe Navi, Lebanon, both of N.J.; Joseph Krupp, Bangor, Pa.

[73] Assignee: American Newspaper Publishers Association, Incorporated, Easton, Pa.

[21] Appl. No.: 630,223

[22] Filed: Nov. 10, 1975

[51] Int. Cl.[2] ..... B65H 5/30

[52] U.S. Cl. ..... 270/55

[58] Field of Search ..... 270/54-58

[56] References Cited

U.S. PATENT DOCUMENTS

| | | | |
|---|---|---|---|
| 2,634,971 | 4/1953 | Schweizer | 270/55 |
| 3,420,516 | 1/1969 | Guggisberg | 270/55 |
| 3,711,083 | 1/1973 | Cantrell | 270/55 |

*Primary Examiner*—Edward M. Coven
*Assistant Examiner*—A. Heinz
*Attorney, Agent, or Firm*—David H. Semmes; Warren E. Olsen

[57] ABSTRACT

An improved high speed in-line inserting method and apparatus which allows a modular construction and greater simplicity due to reliance on mechanical supporting and gripping procedures. Folded newspapers or other signatures are carried rectilinearly along an endless belt and supported within a pivotable frame and affixed frame. The pivotable frame and the fixed frame are provided on their distal ends with mechanical cam actuated gripping means to positively open a newspaper which includes a folded lap on its top half so that an insert may be impelled into a forwarded and upwardly opening pocket. The thusly formed composite newspaper is then advantageously discharged onto a self shingling endless belt below the first endless carrier belt. Inserts for impelling into the signature or folded newspaper are advantageously disclosed to be fed from a feeder hopper which includes a vibrating end plate and a bottommost feed through a suction pick-up and nipper rolling procedure.

10 Claims, 10 Drawing Figures

MODIFIED HIGH SPEED PAPER INSERTING APPARATUS AND METHOD

BACKGROUND OF THE INVENTION

1. Field of the Invention

This application is related to the copending applications of common assignment entitled HIGH SPEED IN-LINE PAPER INSERTING APPARATUS AND METHOD, Ser. No. 427,763, filed Dec. 26, 1973, now U.S. Pat. No. 3,926,423 and its related application Ser. No. 520,179, filed Nov. 1, 1974, and now U.S. Pat. No. 3,988,016.

The present application deals with the problem of supplying one or more inserts into a folded newspaper jacket in the most expeditious and efficient manner possible. Because the newspaper industry has been continuing a very successful effort in increasing press speeds for the papers which are printed and processed there has existed a need for a particularly efficient manner of inserting inserts, and a primary aspect of the efficiency is having the speed of the insertig operation synchronized to the output of the existing press and conveyors supplying the folded newspapers into the mailing area.

In the mail area of most newspaper operations the inserts, which may be supplements or any other form of printed matter which have to be collated and integrated to form a composite newspaper, have in the past been either inserted by a partially automated operation or with various automated machines.

The instant invention, like the above-noted related applications, categorically avoids any centrifugal or coriolis acceleration effects which are inherently present when a folded newspaper, or any other signature, is accelerated in a curved path in either a vertical or a horizontal plane. By avoiding any curved path of travel for the pocket formed within the folded newspaper there are no compound problems when speeds are tremendously increased. In other words, by adopting an in-line approach for the period of travel during which the insert is to be impelled into the pocket within the folded newspaper, operating speeds are not compounded or limited by extraneous centrifugal coriolis acceleration effects inherent in any system which moves along other than an in-line path.

The present invention discloses an improved method and apparatus which allows particularly advantageous synchronization between the speed of insertion of supplements and presses feeding the same.

2. Description of the Prior Art

The following patents illustrate various prior art inserting devices which have in the past been employed to allow insertion of an insert into a folded newspaper or other type of signature:

WICH: U.S. Pat. No. 1,774,580
SCHWEIZER: U.S. Pat. No. 2,461,573
SCHWEIZER: U.S. Pat. No. 2,634,971
MITCHELL: U.S. Pat. No. 2,796,255
CANTRELL: U.S. Pat. No. 2,856,182
SCHLUCKEBIER: U.S. Pat. No. 3,269,720
GUGGISBERG: U.S. Pat. No. 3,420,516
REIST: U.S. Pat. No. 3,527,455
PATERSON: U.S. Pat. No. 3,663,008
CANTRELL: U.S. Pat. No. 3,711,083
BRYSON: U.S. Pat. No. 3,874,649
KLUGE: U.S. Pat. No. 3,877,692
BRYSON: U.S. Pat. No. 3,881,716

Wich illustrates an early newspaper inserting machine which allowed an extended lap to be held while the bottom half falls by gravity, as assisted by an air blast and mechanical fingers, to define a pocket. Wich employs a triangular path for the newspapers into an eventual deposit on a horizontal take-off at one corner.

The patents to Schweizer illustrate exemplary prior art devices where the folded newspapers are conveyed in a circular orbit in a horizontal plane. Additionally, the Schweizer teachings rely upon a vacuum for separating the folds of the newspaper together with articulated pocket assembly for holding the folded newspaper. In the present invention there is a complete in-line approach for the folded newspaper during its entire travel on a device, and the newspaper is further not supported within the pockets but is rather supported on a rectilinear moving endless belt through contact with the folded edge of the newspaper.

The patent to Mitchell illustrates another newspaper stuffing device which translates signatures in a circular orbit in a horizontal plane and similarly employs an articulated pocket means for both supporting and opening the folded newspapers in its circular orbit.

The newspaper stuffing machine of Cantrell is a stationary device which, at FIG. 4, is illustrated to combine sources of newspapers and inserts for processing between stationary and pivotable rollers. The stuffer of Cantrell does not employ an in-line rectilinear travel, but rather employs rigidly mounted pockets for subsequent feeding onto a conveyor.

The inserter of Schluckebier typifies an inserter which carries folded newspapers for insertion in a circular orbit in a vertical plane. In the instant device there is a complete in-line rectilinear movement of the folded and composite newspapers without any of the centrifugal or coriolis effects inherent in a very high speed operation according to any such non-linear path of travel. Similarly, Guggisberg teaches an inserter with cammed pockets for holding and opening folded newspapers for insertion while transversing a circular orbit in a vertical plane.

The patent to Reist employs another type of continuous inserter where the folded papers traverse a curved path in a vertical plane. For this purpose Reist uses a continuous chain with grippers for gripping the distal ends of the folded newspaper as the only guiding and support for the folded newspaper during its arcuate travel.

The stuffer of Peterson illustrates a modular construction for an arcuate stuffing operation around an obstacle, such as a centerpost in a building. Around the circumference of the circular orbit in a horizontal plane various tables are provided for insertions.

The newspaper inserting machine of Cantrell teaches a continuous line of conveyed buckets with each bucket including both mechanical and vacuum devices for maintaining and producing a pocket in a folded newspaper. As shown in FIG. 10 the buckets traverse a circular arc in the vertical plane to the eventual deposit point on a bottom conveyor. In the present invention there is no requirement for a vacuum means for opening a pocket in a folded newspaper, and the entire inserting and discharge operation is accomplished through the support of the folded edge of the newspaper along a continuous belt in a rectilinear direction. Composite newspapers in the instant invention are discharged with the folded edge downwardly onto a second rectilinear conveyance so that the composite newspapers need not be accelerated in a curved path around the large diameter sprockets supporting the continuous chain drive.

The earlier Bryson patent illustrates another configuration for combining insertion stations around a circular orbit of folded newspapers in a horizontal plane. The inserter of Kluge specifically relies upon centrifugal force to open a pocket in a folded newspaper to provide for the introduction of an insert. The later Bryson patent supports a composite interconnection of stuffers arranged around a circular orbit in a horizontal plane.

None of the above-noted inserter references teach a structure according to the instant invention. It is an object of an instant invention to provide for a particularly efficient in-line insertion operation where positive mechanical engagement of the respective moving parts is by a cam actuation as a function of in-line position, without reliance upon electrical or electro-mechanical coordinations. Similarly, the positive manner of supporting the folded edge of the newspaper according to the instant invention on an endless in-line surface during the entire formation of a composite newspaper precludes adverse pocket formations due to centrifugal or coriolis acceleration phenomena.

It is a further object of the invention to avoid reliance on vacuum or electromechanical actuation of structure to form the pocket in the folded newspaper, but rather to provide for positive cam actuation of a gripper assembly on the distal ends of the folded newspaper as a function of the folded newspapers position on a rectilinear path of travel.

It is a further object of this invention to positively support a jacket at its folded edge upon an endless belt during the entire insertion operation.

Further objects and advantages of the instant invention may be more clearly understood with reference to the following more detailed description and drawings.

SUMMARY OF INVENTION

The present invention provides a method and apparatus for the practice of a method which allows for high speed in-line inserting of supplements to newspapers. According to the method of the instant invention a newspaper is initially folded to provide an extending lap on the top half of the folded newspaper with respect to the bottom half and then conveying the folded newspaper as a folded jacket with the folded edge forwardly disposed to a speed up station. At the speed up station the folded edge of the jacket is accelerated rearwardly and downwardly for a rectilinear series of steps during which the folded edge is rectilinearly conveyed while being maintained rearwardly and downwardly with respect to the extended lap on the first half of the folded paper.

The method according to this invention is practicable with any number of inserting devices and for this purpose there is taught an apparatus for the practice of the method which allows for a modular construction of any number of inserting stations along the path of the conveyor. In the first section the method provides for supporting the folded edge as a first rectilinear conveyance with the extending lap maintained in a first position forwardly and upwardly disposed relative to the folded edge. During the first rectilinear conveyance the top distal end of the first half of the folded newspaper, with the extending lap, is pivoted in the trailing direction, with respect to the direction of conveyance, and relative to the folded edge as a function of its position along the path of travel of the belt. In so doing the folded newspaper is effectively clamped momentarily between a fixed frame and a forward learning pivotable frame so that at a subsequent linear position only the first half with the extended lap is pivoted forwardly to thereby define a forwardly and upwardly opening pocket between the first and second halves of the newspaper. With the pocket thus defined at least one insert may be impelled rearwardly and downwardly into the forwardly opening pocket to thereby define a composite newspaper.

As a final operative step of the method according to the instant invention there is a further discharge position where the rectilinearly conveyed folded edge of the composite newspaper is guided downwardly onto a second rectilinear conveyance immediately below the first. The folded edge of the newspaper is then supported between the bottom half of the endless belt comprising the first conveyance and the top of a second endless belt thereby carrying the discharged composite newspaper in a shingled array through a distance to a bundling operation.

The method according to this invention is illustrated in preferred embodiment to be practiced by an apparatus which includes a first endless belt which supports the folded edge of the newspapers upon its upper portion, in a horizontal plane, as it is rectilinearly conveyed with the pocket formation being accomplished by plurality of jacket receiving means each comprising a fixed frame and a pivotable frame. The plurality of jacket receiving means are advantageously disclosed to be guided by the frame of the device while being conveyed through a removable engagement with endless chains on either side of the first endless belt.

The pivotable frame together with the fixed frame acts, with reference to the forward direction of rectilinear travel, as a forward and rearward support for a folded newspaper or signature held therein. The fixed frame and the pivotable frame define, therefore, a bottomless carriage means with the forward facing pivotable frame required only to pivot between a relatively closed and a relatively open position. Because the folded edge of the folded newspaper is carried upon the first endless belt there is no requirement for large articulations of the pivotable frame on the jacket receiving means. Of course whenever large scale travels of machine elements are avoided inertial effects are minimized and the rectilinear speed of the path may be correspondingly optimized to its maximum.

The apparatus according to the instant invention further includes lap edge gripping means mounted upon the distal ends of each of the pivotable frame and the fixed frames, the proximate ends of said frames being located near the plane of the forward travel for the first endless belt. In the preferred embodiment of the apparatus herein the lap edge gripping means are actuated by a fixed stop or other type of direct cam actuation positioned along the rectilinear line of travel. By relying on a gripper assembly which is not servocontrolled either by vacuum or electromechanical interconnections the positive actuation of the grippers will not be defeated by a failure of either a vacuum or electrical source.

The apparatus for impelling an insert downwardly and rearwardly into a pocket which is formed according to the instant invention may include a feeder hopper of the type disclosed in the copending application of common assignment, Ser. No. 520,179, now U.S. Pat. No. 3,988,016, as hereinabove referred to.

The discharge station forms an essential part of the apparatus according to the instant invention. By supporting the folded edge of the newspaper on a first continuous or endless belt the discharge apparatus essentially comprises a rectilinear station including an end pulley supporting the first endless belt around the circumference of which the folded edge of the composite newspaper will be accelerated downwardly onto a second endless conveyor. The distal end of the composite newspaper will then contact an ejector guide roller and, through frictional contact with the top half of the composite newspaper, be shingled onto the second conveyor.

Moreover, other features and advantages of the invention will become apparent by reference to the following detailed description and drawings.

DESCRIPTION OF THE PREFERRED EMBODIMENT

Figure 1:
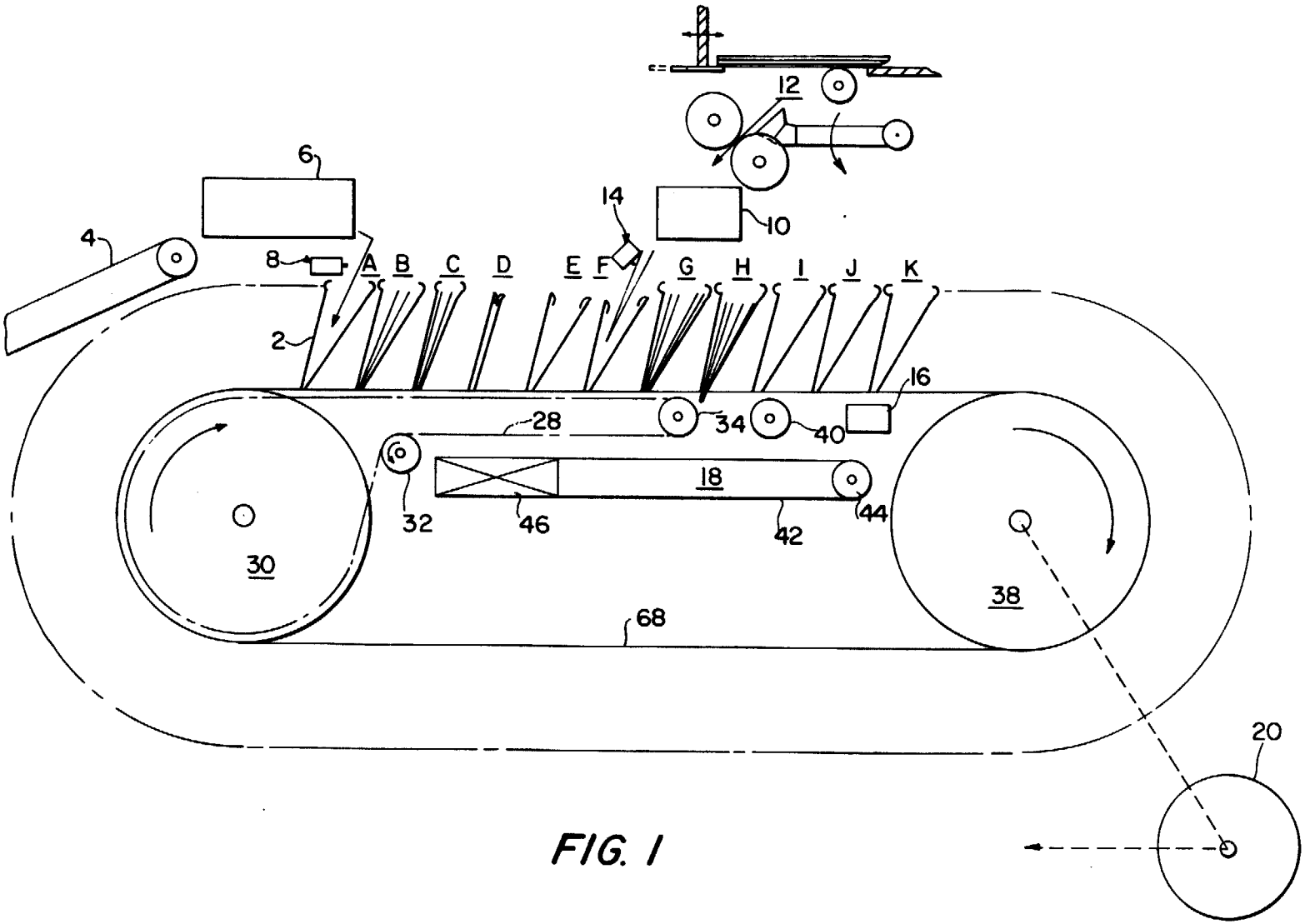
FIG. 1 schematically illustrates in a front view the method and apparatus according to the instant invention.

Referring now particularly to the drawings, FIG. 1 schematically illustrates the method and apparatus according to the instant invention. The carriers 2 receiving the folded newspaper are schematically shown in various rectilinear positions A-K. The jacket carrier schematically shown at 2 consists of two metal plates positioned on two metal blocks as hereinafter described. The two plates are apart at the bottom with the leading plate pivotable between a first position as shown at 2A to a second position as shown at 2D. A deshingling conveyor 4 receives folded newspapers from existing newspaper press. Deshingling conveyor 4 is simply part of the press conveyor system and driven by the press to carry shingled jackets into the mailroom and to the apparatus and method according to the instant invention. As shown in FIG. 1 there is a synchronizing unit simply represented at 6 which receives the individual folded newspapers and impels them downwardly into the carrier assembly shown at position 2A. The type of synchronizing unit 6 is conventional and any feeding device may be used without critically according to the instant invention. The abovenoted related application, now U.S. Pat. No. 3,926,423, further illustrates a conventional newspaper folder and a speed up station operable for accelerating a folding jacket into the rectilinear conveyance as taught by the present invention. Also shown schematically in FIG. 1 is a jacket monitoring system 8 which may consist of any type of mechanical or optical sensor to simply monitor the passage of a folded newspaper jacket into the carrier at position 2A.

Similarly there is shown schematically at 10 an inserting station to represent one or more inserting stations adapted to impell an insert rearwardly and downwardly into a carrier containing a folded newspaper at position 2F. Again any type of inserting station at 10 may be employed, including those as disclosed in the pending application of common assignment hereinbefore discussed specifically the commonly assigned U.S. Pat. Nos. 3,926,423 and 3,988,016. As shown schematically at 12 one form of automatic conveying and loading section for stacked inserts is illustrated to have a vacuum pick-up member which rotates to grip the underside of the bottommost insert and feed the insert between an upper and a lower nipping roller. As further shown at 12 an end plate is advantageously employed to reciprocate a retractable finger to facilitate the pick-up and discharge of an insert from the feeder hopper. The details of the inserter per se are no part of the instant invention and again reference may be made also to the copending application of common assignment Ser. No. 520,179 as hereinbefore discussed.

Also schematically shown at 14 is an insert monitoring system which again may be of an electrical or optical type to sense the presence of the folded jacket at station 2F; if there is no jacket at 2F there will be no insert from inserting station 10. Such an insert monitoring system may simply comprise a register and a clock for registration purposes. These registers can be either connected with other inserter heads if individual decisions to feed or not to feed are required or be a single register if only a yes/no answer is to be utilized. This type of peripheral electronic package is again known, per se, and any counter mechanism responsive to a signal for activating the inserting station at 10 would be suitable, and therefore is not further illustrated. Also schematically illustrated at 16 is a reject mechanism for partially inserted jackets. The type of reject mechanism may be of any type, operable as the carrier traverse from position 2G to position 2K. The reject mechanism 16 could include an ancillary system which could be moved into position between rollers 34 and 40 to carry the folded edge in the jackets between these positions rightwardly preventing them from being deposited onto the lower discharge conveyor 18, as will be described hereinafter.

It is also shown schematically in FIG. 1, the forward end section includes a large diameter sprocket and roller drive assembly 30 which both carries a chain for engagement with the support blocks of the carrier 2 in its various positions while acting as a drive member for the first endless belt conveyor 28. The endless belt 28 is trained around the drive wheel 30 and is also supported as shown by belt rollers 32 and 34. The rear end section comprises essentially a large diameter chair roller 38 which may involve a synchronizing mechanical interconnection 20 with the existing press which feeds the shingled newspapers by virtue of deshingling conveyor 4. The high speed in-line inserting method and apparatus herein comtemplates coordination of the inserting apparatus with the existing presses to allow a total line production of finished composite newspapers within the mailroom. The end roller 34 for the first endless belt 28 is spaced at approximately position 2H to cooperate with the parallel and forwardly spaced guide roller 40. As a composite newspapers traverse the endless belt rectilinearly past the guide roller 34, the folded edge will be accelerated downwardly so that the first half of the composite folded newspaper will contact guide roller 40 as each carrier assembly reaches the position 2I. Thusly, the rectilinearly conveyed composite newspapers are simply and effectively shingled onto the second parallel conveyor position 18 below first endless belt 28. The second conveyor system 18 includes another endless belt 42 which travels counterclockwise as viewed in FIG. 1, with its top surface running parallel and spaced below the bottom surface of the clockwise travel of and the first endless belt 28. Therefore it can be seen that newspapers accelerated downwardly onto the second rectilinear conveying belt 42 will be shingled between the bottom of belt 28 and the top of belt 42 and carried, advantageously, to a right angle or side delivery roller assembly schematically illustrated at 46.

Figure 2:
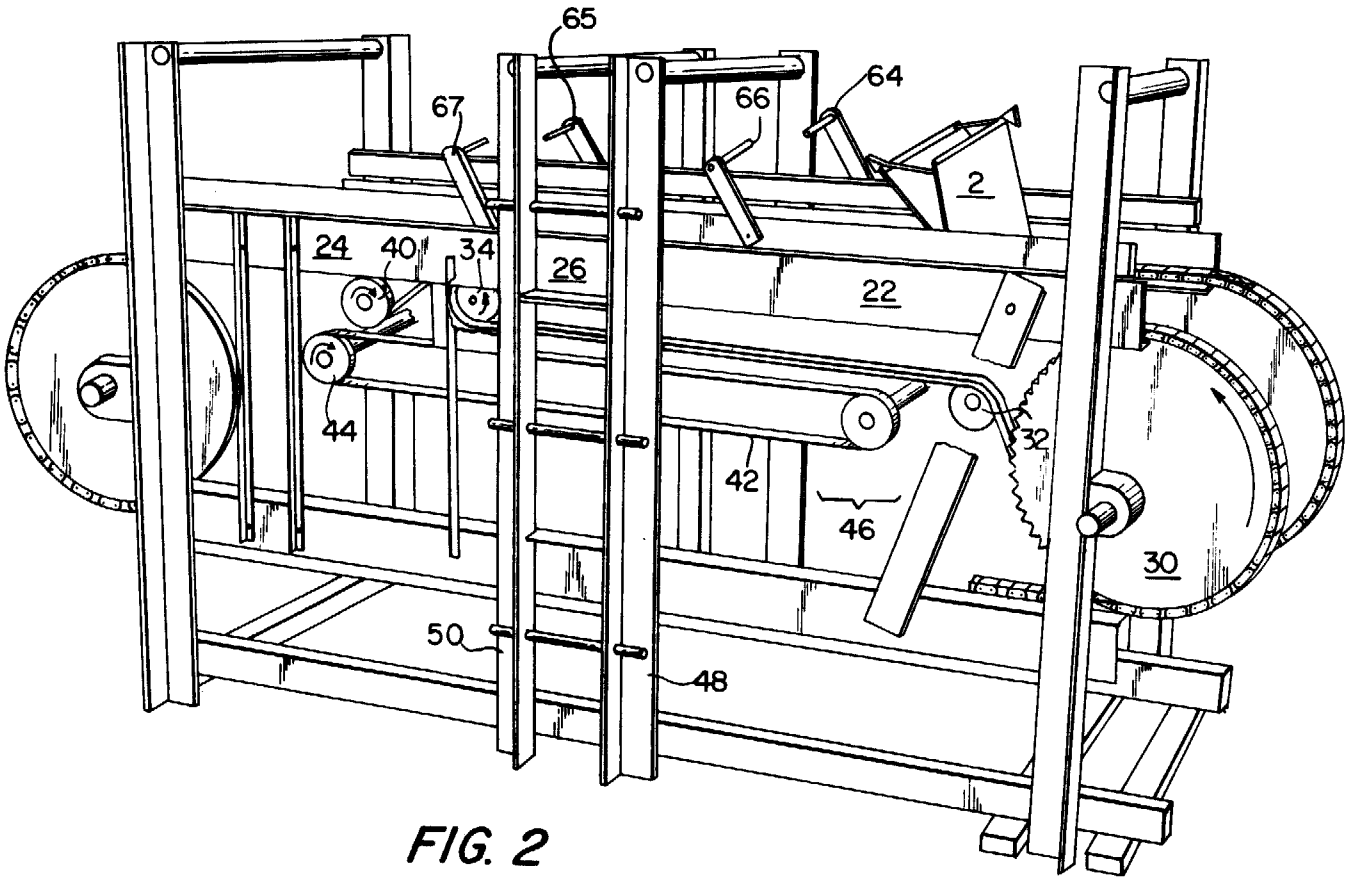
FIG. 2 is a schematic representation of a prototype according to the instant invention showing its modular form.

Referring now to FIG. 2, a prototype of the in-line carrier assembly according to the instant method and apparatus is shown comprising a forward end section 22 and a rear end section 24. Between these forward and rear sections is schematically shown a removable center section 26 which would be proximate the inserter section 10 in the representation of FIG. 1. The forward and the rear sections may be standard items in a manufactured version of this device with connector and support members 48 and 50 to allow any width center section 26 to be placed there between. The size of the center section 26 would be dictated by the number of inserter stations required together with space considerations in the particular operation. As further shown in FIG. 2 there are fixed stops on the left at 64 and at the right at 66 to act as positive mechanical locations for cam actuation of the grippers onto the distal ends of the lap folded newspaper. The essential structure illustrated in FIG. 2 includes the belt roller 32 which trains the first endless belt around the large chain drive and first endless belt roller 30 so that a positive interconnection between speed of first endless belt 28 and the travel of the frames comprising the carrier 2 may be maintained. As further illustrated in FIG. 2, a first endless belt pulley 34 is spaced parallel from guide roller 40 to allow a downward acceleration and a shingling of composite newspapers onto the second conveyor belt 42. A carrier is shown at the 2F position in FIG. 3 along with a more detailed showing of the positive mechanical camming action for the gripper assemblies. The carrier 2 is shown as a pivotable frame 78 which is fixed into a pivotable block which is spaced forwardly of the fixed frame 62. The pivotable frame 78 and the fixed frame 62 define a forwardly and upwardly open pocket which is closed on the bottom by the top surface of the first endless belt 28. The pivotable front plate 78 carries at its distal ends a gripper assembly 54. The gripper assembly 54 is mounted upon a shaft and includes extending fingers 58 which are actuated by engagement of a fixed stop 67 with the triangular cam 80. In the position shown in FIG. 3, corresponding to 2F of FIG. 1, the fixed stop 67 will engage the bottom of the triangular cam 80 as the carrier is moving rightwardly; thusly opening the grippers 58 from contact with the distal ends on the extending lap existing on the first half of the folded newspaper.

Figure 3:
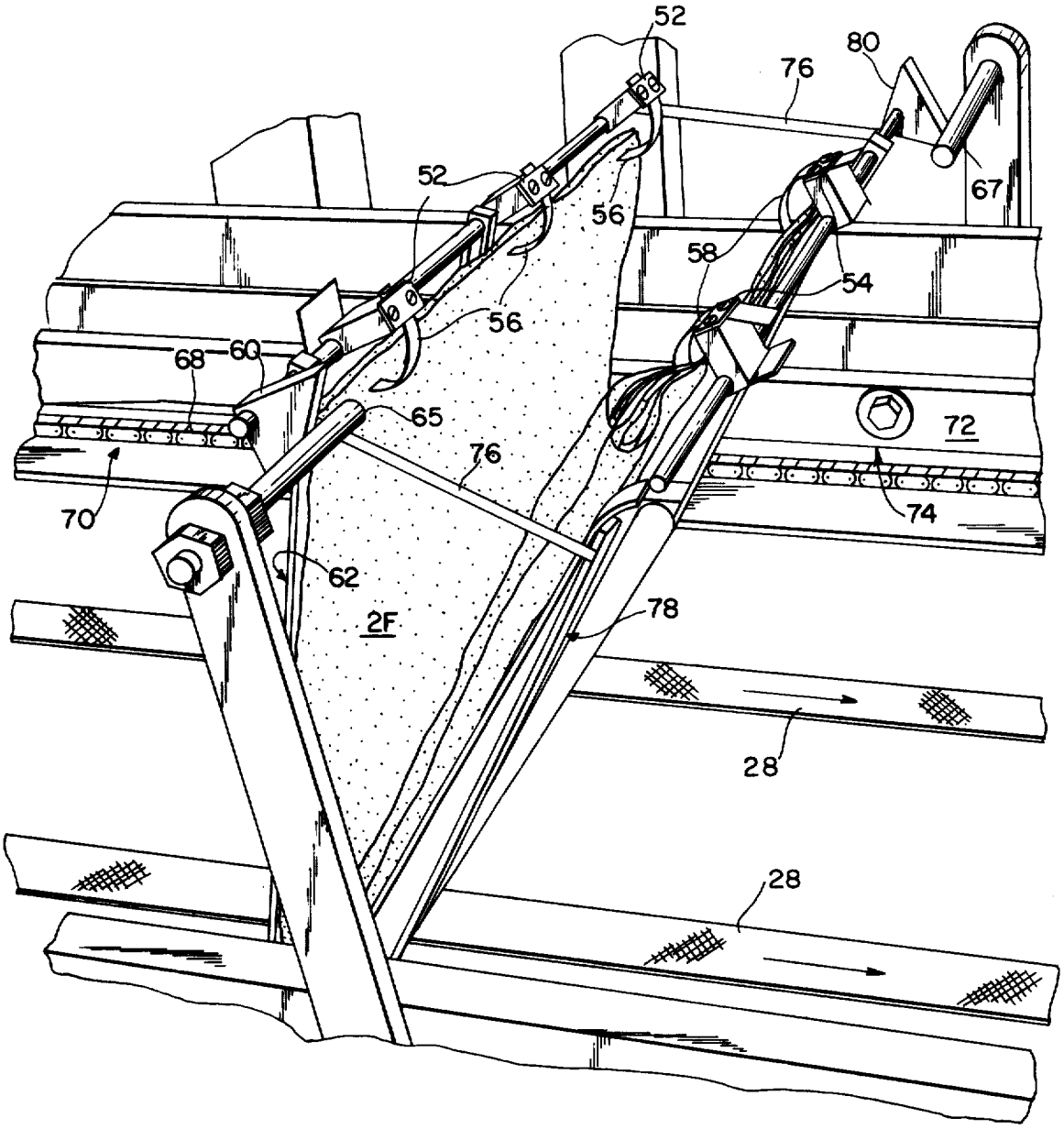
FIG. 3 is a schematic illustration of a folded newspaper in the position 2F of FIG. 1.

Similarly, the fixed frame 62 carries at its distal end the gripper assembly 52 including fingers 56 all rotatably mounted upon a shaft which includes an actuating triangular cam 60. Again with reference to position 2F, as shown in FIG. 1, as the fixed stop 65 engages the top quadrant of the rightwardly travelling triangular cam 60 the grippers with fingers 56 will be urged away from the distal ends of the lap on the bottom half of the folded newspaper. As shown in FIG. 3 there are three fingers comprising the gripper assembly on the fixed frame 62 and two intermeshing fingers 58 on the pivotable frame 78. The entire carrier assembly 2 is supported upon the frame of the machine, particularly the supporting surface 70. The carrier 2 itself is moved rightwardly as shown in FIG. 3 by interconnection with the chain 68 which engages the large sprocketed drives 30 and 38 of FIG. 1. While the operation of the gripper assembly has been explained it should be noted in FIG. 3 that there is a stationary cam surface 74 formed by a cam surface 72 also rigidly afixed to the frame of the machine. As will be hereinafter shown the pivoting of the pivotable frame 78 is limited to a maximum travel by flexible connector lines 76, together with the shape of inclined surface 74 at various rectilinear positions along the sequence of the rectilinear travel.

Figure 4:
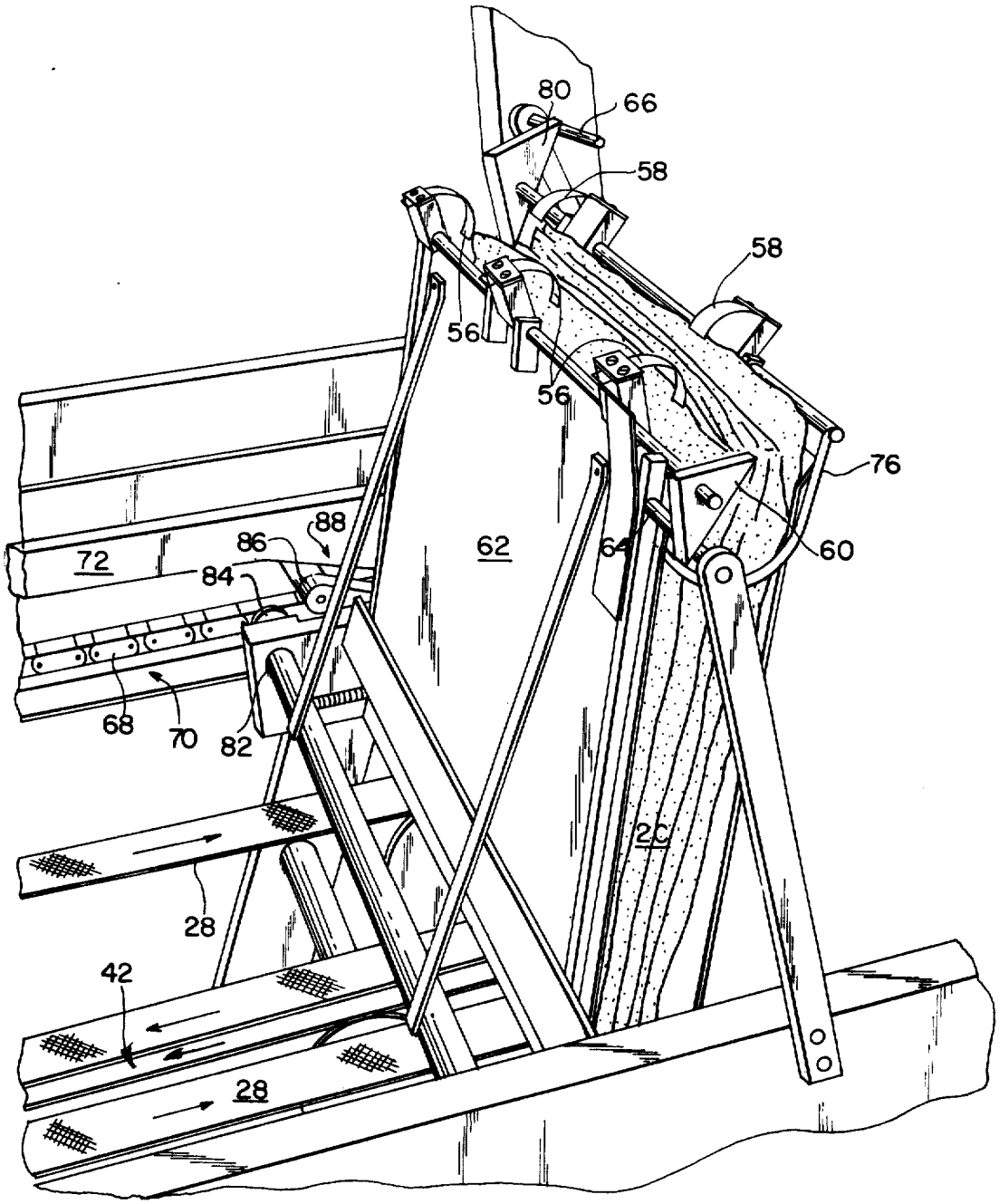
FIG. 4 is a schematic representation of the apparatus and method according to the invention at the position 2c of FIG. 1.

FIG. 4 illustrates a detail of a prototype according to the instant invention with the carrier in the position shown at 2C of FIG. 1. At this position, which is of course prior to the position of FIG. 3, another stop 64 has just engaged the triangular cam 60 on the fixed frame 62 while coincidentally the fixed stop 66 has just engaged triangular cam 80 on the pivotable frame 78. As is further shown in FIG. 4 the fixed frame 62 is mounted in a carrier block which includes rollers 84 for contact with the top of frame surface 70. Additionally there is a cam follower 86 connected to an arm for pivoting the pivotable frame 78 with this roller 86 shown engaging the cam surface 88 on the cam plate 72.

Figure 5:
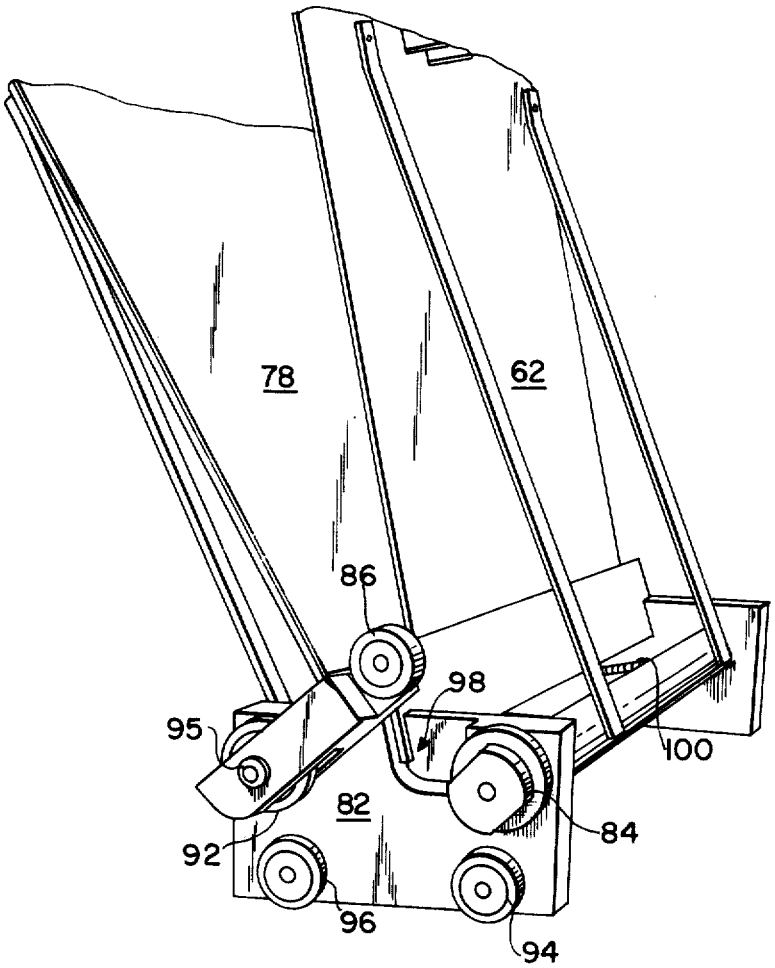
FIG. 5 is a detailed illustration of a carrier according to the instant invention.

The jacket carrier is shown in greater detail in FIG. 5 to comprise a fixed frame 62 which is mounted at 98 into a carrier base frame or block 82. Spaced from the fixed frame 62 is the pivotable frame 78 which is actuated by roller cam 86. This entire frame is mounted to the chain 68 with the guide rollers 84 and 92 resting on the frame surface illustrated at 70 in FIG. 4. To further maintain the stability of the carrier on the surface 70 there are also lower guide rollers 94 and 96 which would engage the bottom of rail 70 illustrated in FIG. 8. The pivotable frame 78 is urged to an open position by any sort of resilient spring assembly 100 which will maintain the roller cam 86 against the complementary cam surface. When the carrier is over the discharge station, corresponding to 2I in FIG. 1, it can be seen that the guide roller 40 will rest against the top half of the composite newspaper as it is accelerated downwardly from the first endless conveyor 28 to the oppositely directed top belt of the second endless conveyence 42. The end rollers of the first endless conveyor 34 and guide roller 40 are parallel and spaced apart, with the roller 40 spaced forwardly of 34 so that there will be a gradual shingling of subsequent composite folded newspapers onto one another below. Therefore this station takes a substantially vertical newspaper and automatically shingles them on a lower delivery means.

Figure 6:
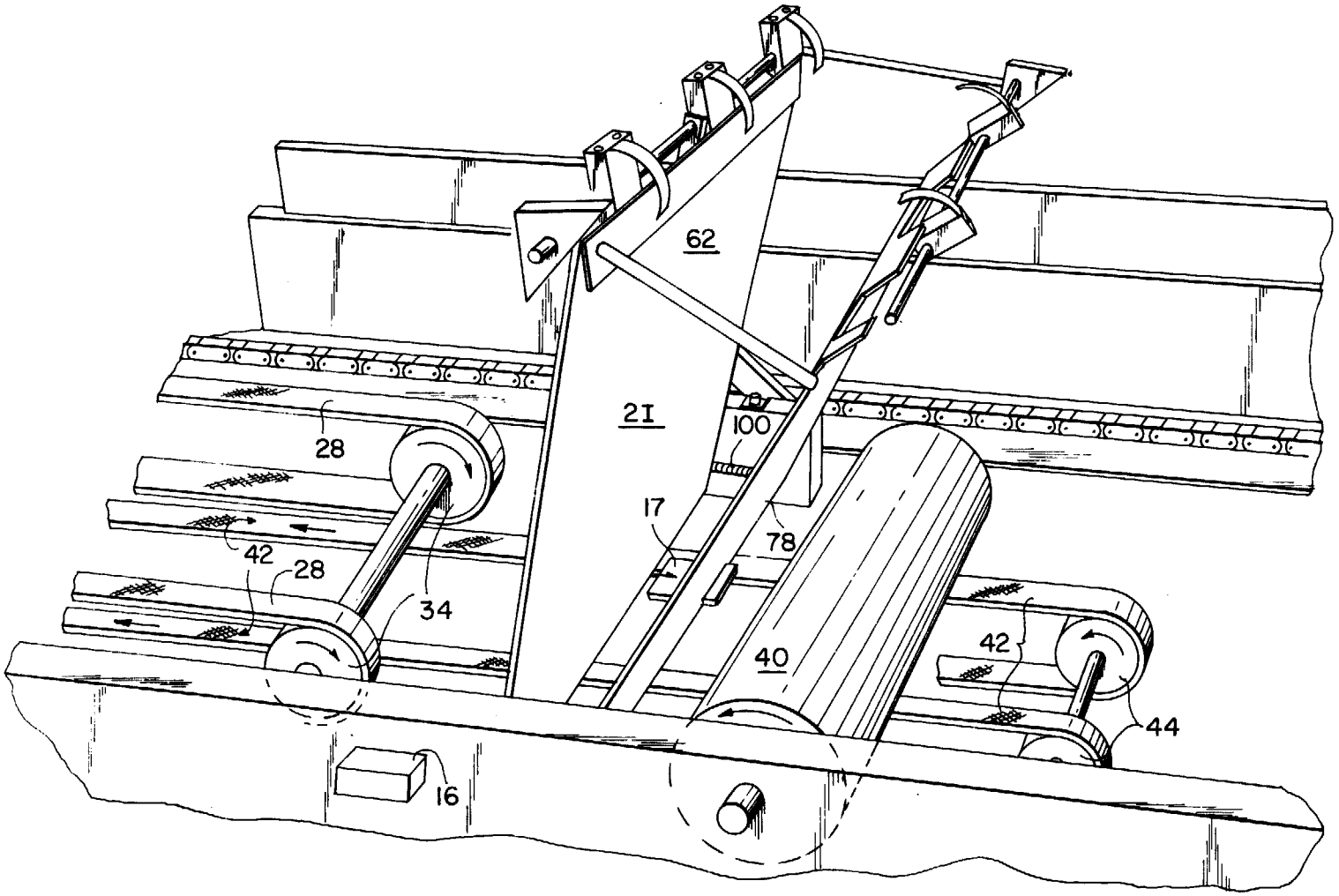
FIG. 6 is an illustration of a prototype of the invention at the position 2I of FIG. 1.

As further illustrated in FIG. 6 the second endless belt 42 is supported on a plurality of end rollers 44 spaced with the top of the second belt 42 parallel and below the bottom of endless belt 28. Similarly the first endless belt in the preferred embodiment is supported on a pair of spaced apart end rollers 34 thereby defining an open area between the pulleys 34 roughly comparable to the space between the end pulleys 44. This is further illustrated in the 2I position of FIG. 6. The fixed plate 62 and the pivotable frame 78 are apart at their bottom ends and in close proximity to the top of the endless belt 28. It is contemplated that the schematic illustration of a reject mechanism shown schematically at 16 in FIG. 1 may include an electrically controlled sensor 16 to cooperate with a horizontally slidable element 17 proximate this bottom opening in the carrier. As a reject mechanism such a slide member 17 could be quickly interposed to close off the opening in the bottom of the carrier in response to a signal from the reject mechanism 16; thereby avoiding discharge of a selected newspaper which has been indicated to not contain an insert, for example, by insert monitoring station 14 of FIG. 1. The rejected composite newspaper may then be removed before carrier 2 would progress around the rear end section chain drive 38. Rejects would not be shingled onto the lower second endless belt 42 with the properly inserted composite newspapers.

Figure 7:
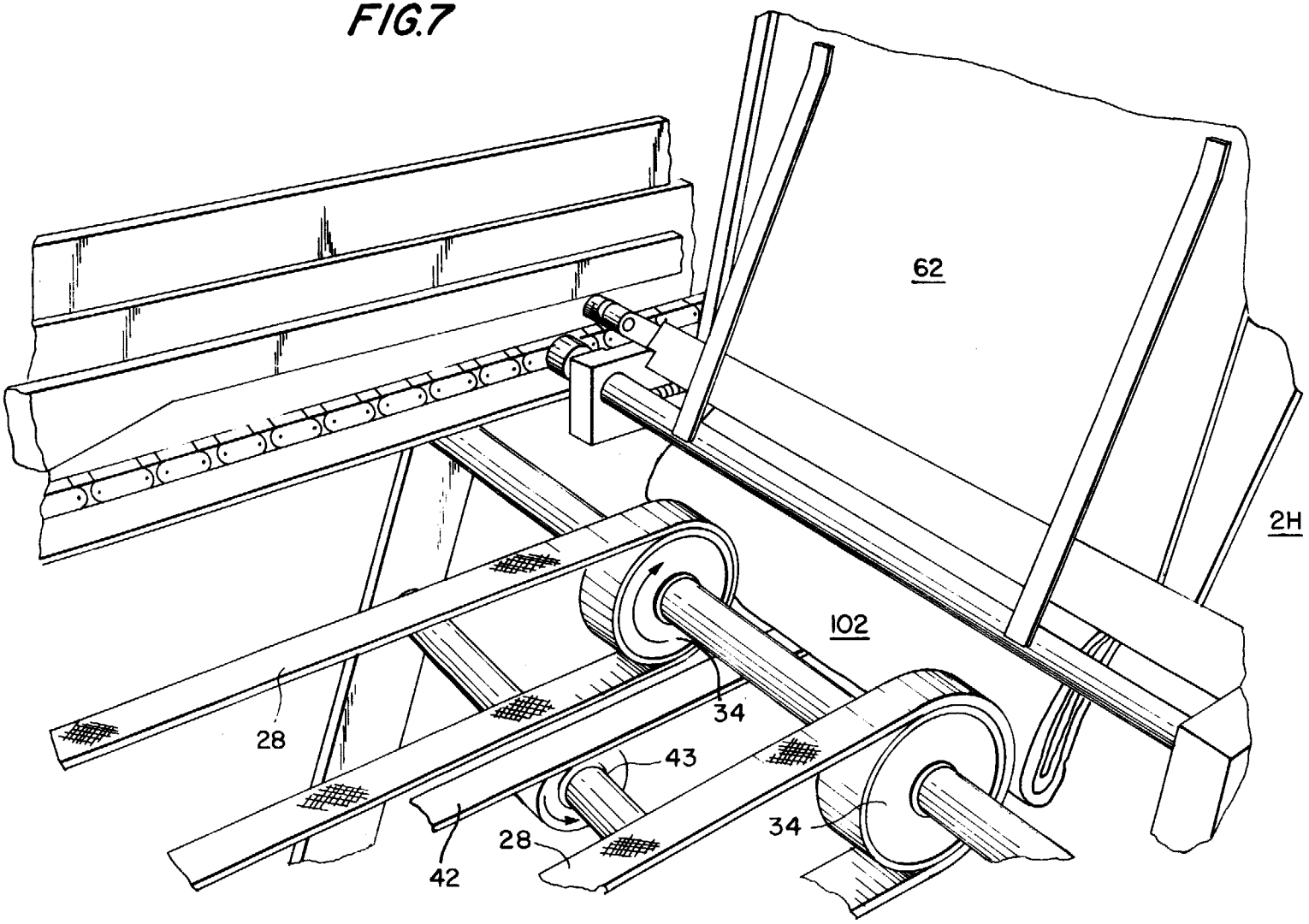
FIG. 7 illustrates discharge of a newspaper at the discharge station.

At FIG. 7 a representative composite newspaper 102 is accelerated downwardly around the end pulleys of the first endless belt 28 and onto the top surface of the second endless conveyor 42, shown supported by an idler pulley 43.

Figure 8:
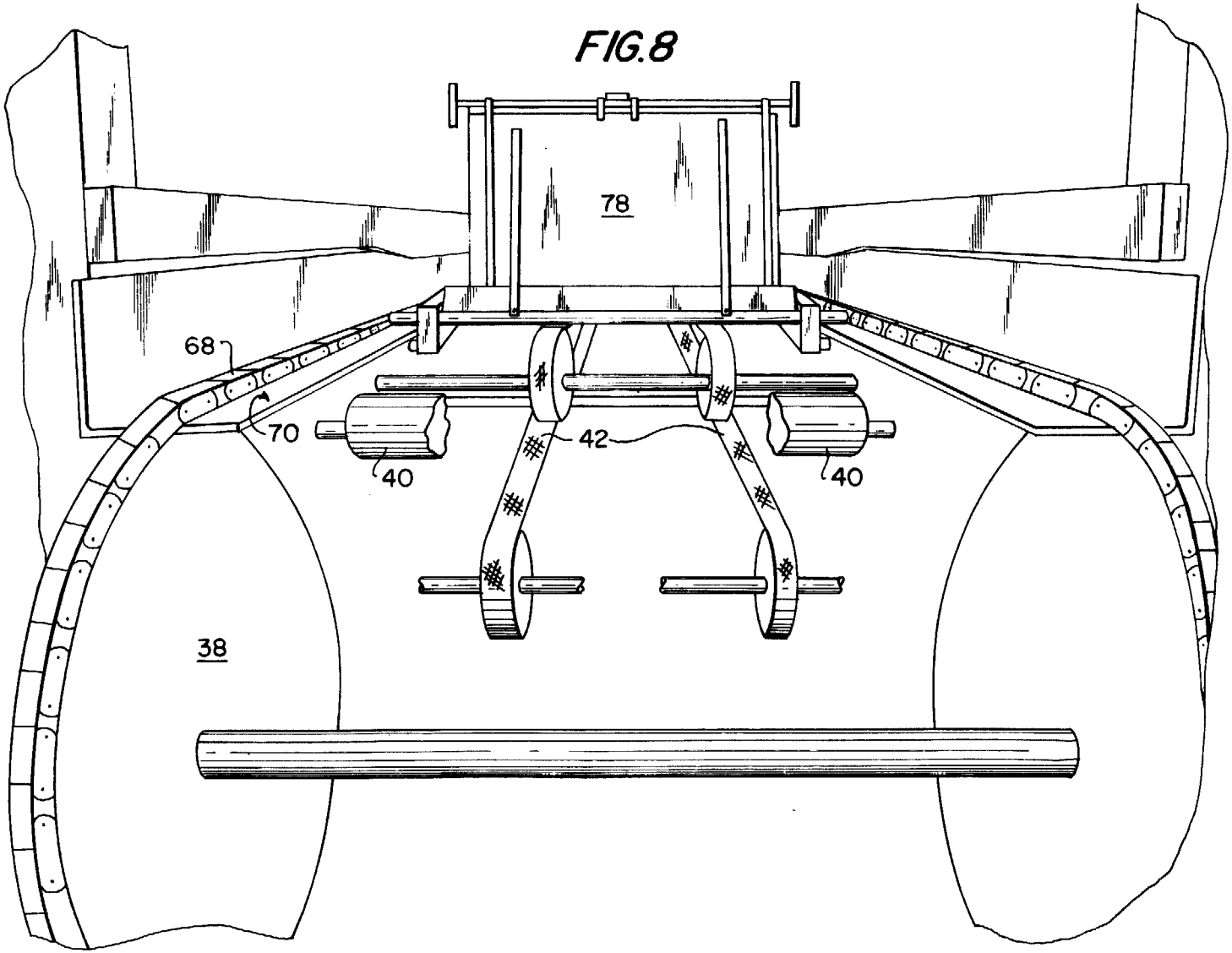
FIG. 8 is another view of the discharge station and a prototype form.
Figure 9:
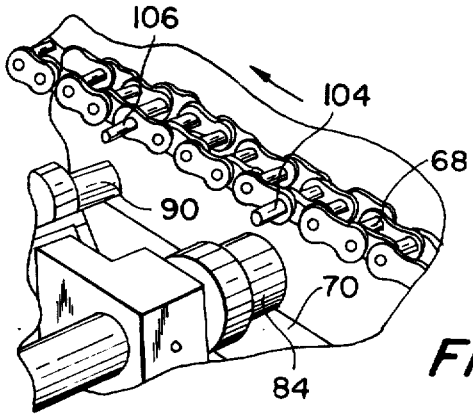
FIG. 9 is a detail of interconnection of the carrier and chain drive according to a prototype.

A view of the rear end and discharge section according to the invention appears in FIG. 8. The carrier with the pivotable frame 78 tilted forward is shown riding on the frame member 70 and by a pin connection through the chain 68. The pin connection between the carrier 2 and the chain 68 is more particularly shown in FIG. 9 where the pivot axis 90 of the pivotable frame 78 includes a female receiving end engageable with inward pin 106 on the chain 68. Similarly the supporting rollers 84 include corresponding female end sections to receive another pin shown at 104 on chain 68. The spacing of the carrier pins 106 and 104 may be chosen to determine the pitch between the respective carriers. With the positive support of the carrier on the frame member 70 there is no need for a locking engagement between the pins 104, 106 and the carrier assembly. Therefore the carriers may be easily removed and replaced or added to as the need arises further consistent with the modular concept as taught herein.

Figure 10:
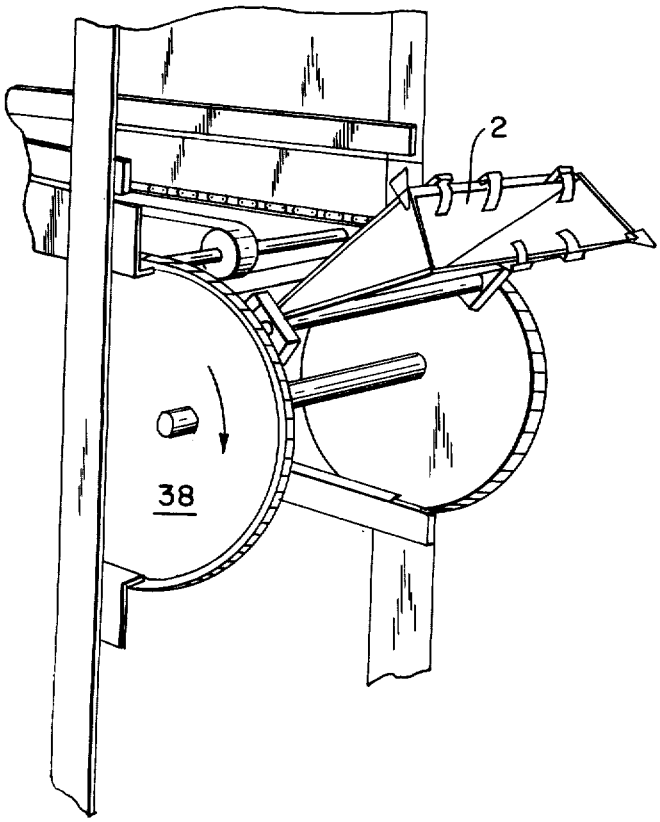
FIG. 10 illustrates a returning travel of the empty carrier.

Finally as shown in FIG. 10 the rear end section is illustrated to carry a normally empty carrier assembly around its periphery. In this position there is no concern for the centrifugal and coriolois acceleration effects upon the carrier 2 per se because the composite newspaper will have been previously rectilinearly carried and discharged to a lower rectilinear shingling conveyance. Therefore there is no complication to the inserting process from this returning position as shown in FIG. 10 for the carrier. As hereinbefore indicated, should the reject mechanism 16 selectively close off the bottom of the carrier 2, a rejected composite newspaper will be preferably discharged prior to this arcuate movement. For example, when the carrier 2 linearly proceeds past the end rollers 44 on the second endless belt 42 the bottom closing number 17 may be returned to its normally retracted position. Thus the rejected composite paper will drop down immediately as the carrier rectilinearly passes to the right of rollers 44 as shown in FIG. 6.

Therefore even a rejected newspaper is not subject to an arcuate path of travel and this in-line approach with emphasis upon mechanical actuation and continuous belt support of the folded edge of the composite newspaper presents clear operating advantages necessary and desirable for today's higher press speeds.

While one embodiment of the invention has been shown and described, it is to be understood that certain changes and additions can be made by those skilled in the art not departing from the scope and spirit of the invention, which is to be defined solely by the appended claims.

We claim:

1. A method of high speed in-line inserting of a supplement insert into a newspaper which is being rectilinearly conveyed in a forward direction, and comprising the steps of:

A. folding a newspaper to provide an extending lap on a first half of said folded newspaper with respect to a second half, conveying said folded newspaper as a folded jacket with the folded edge forwardly disposed to a speed up station, and B. accelerating said folded jacket edge downwardly onto a horizontal plane for a first horizontal conveyance and for a rectilinear series of steps wherein said folded edge is rectilinearly conveyed in the plane of said first horizontal conveyance while maintained downwardly with respect to said extended lap, wherein the first half of said folded jacket is disposed in a leading direction with respect to the forward direction of conveying, said rectilinear conveying steps further comprising in sequence:

i. supporting and conveying said folded edge in a forward direction as a rectilinear conveyance, while maintaining said extending lap in a first position inclined and upwardly disposed relative to said rectilinearly conveyed folded edge; and while so conveying said folded edge, further ii. pivoting said extending lap in the trailing direction, relative to said direction of conveyance of said rectilinearly conveyed folded edge, to a second inclined position, and iii. maintaining said second half of said folded newspaper at said second position, and iv. forwardly pivoting only said first half of said folded newspaper towards said first position to thereby define an upwardly opening pocket between said second and first halves of said newspaper, and C. impelling at least one insert downwardly into said upwardly opening pocket to thereby define a composite newspaper; and, D. further rectilinearly conveying the folded edge of said composite newspaper to a downwardly directed discharge station, accelerating said composite newspaper downwardly, with respect to the plane of said first horizontal conveyance, to a second horizontal rectilinear conveyance which is below the plane of said first rectilinear conveyance and opposite in direction with respect to the direction of said first conveying.

2. A method according to claim 1, wherein said insert impelling step further comprises i. engaging an insert with a vacuum gripping member; and ii. swinging said vacuum gripping member and attached insert toward upper and lower nipping rollers; and iii. translating said upper nipping roller into engagement with said insert; and iv. releasing said vacuum gripping member while simultaneously passing said insert between said upper and lower nipping roller and towards said pocket.

3. A method according to claim 1 wherein said composite newspaper discharge step further includes rotating the folded edge of said composite downwardly and rearwardly, with respect to the forward direction and said plane of said first conveyance, around an end pulley supporting a first endless belt, wherein an upper portion of said first endless belt travels forwardly and in the plane of said first conveyance, said second conveyance further comprising conveying said composite newspaper in a shingled fashion by supporting at least a portion of the first halves of said composite newspaper upon an upper surface of a second endless belt which travels relatively rearwardly in the plane of said second horizontal conveyance.

4. A method according to claim 3 wherein said shingled composite inserts from said conveyance are subsequently rotated to a third conveyance which is perpendicular to the relatively rearward direction of said second conveyance.

5. A method according to claim 1 wherein said step of (B) further comprises also accelerating said folded jacket rearwardly, relative to the direction of said first rectilinear conveyance and said step of maintaining said extending lap in a first position comprises a first position wherein the extending lap on said first half of the newspaper jacket is also disposed in a leading direction, with respect to the forward direction of conveying of said folded edge.

6. Apparatus for high speed in-line inserting of a supplement insert into a newspaper, which is being rectilinearly conveyed in a forward direction, comprising, in sequence:

A. A newspaper folding mechanism including means to provide a folded newspaper jacket having an extending lap on a first half with respect to a second half and to convey said folded edge forwardly disposed to a speed-up mechanism, B. said speed-up mechanism being spaced above, and including means to accelerate said conveyed jacket downwardly onto a horizontally disposed means for rectilinearly conveying said jacket in a forward direction, C. said rectilinear conveying means comprising, in combination, a first endless belt having an upper portion operable to be horizontally conveyed in said forward direction and an endless chain adapted to convey a plurality of folded newspaper jacket receiving means that are operatively connected to said chain means, and in linearly spaced successive positions thereon, wherein:

i. said first endless belt operably supports and horizontally conveys, in a first plane of rectilinear conveyance, the folded edge of said folded newspaper, said edge being downwardly with respect to said extending lap, to a rectilinearly disposed discharge point; and, ii. said plurality of jacket receiving means further each comprise a fixed frame and a pivotable frame, said pivotable frame being disposed in a leading direction with respect to the forward direction of conveying, said pivotable frame being operable to support only the first half of said folded newspaper, wherein said fixed frame and said pivotable frame include ends proximate said endless belt, and, together with said upper portion of the first endless belt, are operable to define a pocket which is upwardly open, with respect to the plane of said first rectilinear conveyance, and is rectilinearly conveyed in said forward direction; and iii. newspaper lap edge gripping means, mounted upon the distal ends of each of said pivotable frame and said fixed frame, and operable to selectively maintain the first half of said folded newspaper against said pivotable frame and the second half against said fixed frame; and, iv. means disposed at positions along the rectilinear path of travel of said each newspaper jacket receiving means operable to coact with said pivotable frame as it is conveyed therepast to both selectively pivot the first half of said folded newspaper and selectively engage said gripping means whereby said upwardly open pocket within said folded jacket is selectively defined in said folded newspaper as the folded edge is rectilinearly conveyed, while supported upon the upper portion of said first endless belt; and D. Means, disposed above said first endless belt, for impelling an insert downwardly into said jacket pocket, as it is rectilinearly conveyed therepast, to thereby define a composite newspaper; and, E. Means for discharging said composite newspaper, and comprising a second endless belt spaced below said first endless belt, and including guide means for downwardly directing, with respect to the plane of said first rectilinear conveyance, the folded edge of said composite newspaper from said first to said second belt.

7. Apparatus according to claim 6 wherein said means for impelling an insert further comprises:

i. vacuum gripping means for engaging and gripping a bottommost insert in a feeder hopper;

ii. cam means for substantially simultaneously lowering said vacuum gripping means and attached insert, and raising an upper nipping roller;

iii. means for substantially simultaneously releasing said vacuum gripping means from the insert while passing said insert between said upper nipping roller and a lower nipping roller.

8. Apparatus according to claim 7 wherein said insert feeder hopper further includes a rectractable finger to support said bottommost insert, together with a vibrating end plate to facilitate said gripping and lowering.

9. Apparatus according to claim 6 wherein said discharge means further comprises:

i. an end pulley supporting said first endless belt;

ii. an ejector guide roller parallel to said end pulley and spaced end pulley and spaced forward, with respect to the direction of said conveyance, said end pulley;

iii. said second endless belt having an upper endless belt portion which travels in a direction opposite the upper portion of said first endless belt and is spaced below the bottom of said first endless belt, whereby said folded edges are guided downwardly, from the upper portion of said first endless belt, and between said end pulley and said guide roller onto said second endless belt and thereby said jackets are shingled and carried between said first and second belts in a direction opposite with respect to the direction of said first rectilinear conveyance.

10. Apparatus according to claim 6 wherein said speed up mechanism means also accelerates said conveyed jacket rearwardly, relative to the forward direction of said first rectilinear conveyance, and said pivotable frame together with said endless belt are operable to also define a pocket which is also openable in the leading direction, with respect to the direction of conveying.

* * * * *